United States Patent [19]

Hafner

[11] 4,399,643

[45] Aug. 23, 1983

[54] PANEL LOCK STRUCTURE

[76] Inventor: Joseph A. Hafner, 91 Dover Dr., Stoney Creek, Canada, L8G 2M3

[21] Appl. No.: 211,619

[22] Filed: Dec. 1, 1980

Related U.S. Application Data

[63] Continuation-in-part of Ser. No. 85,352, Oct. 16, 1979, abandoned.

[51] Int. Cl.[3] ..... E04D 1/28

[52] U.S. Cl. ..... 52/530; 52/543

[58] Field of Search ..... 52/529–531, 52/547–551, 556, 276, 478, 520, 543, 519

[56] References Cited

U.S. PATENT DOCUMENTS

| | | | |
|---|---|---|---|
| 1,963,583 | 6/1934 | Jenkins | 52/556 |
| 2,249,125 | 7/1941 | Gabriel | 52/97 |
| 2,264,546 | 12/1941 | Ochs | 52/531 |
| 2,535,620 | 12/1950 | Alvarez | 52/520 |
| 3,110,130 | 11/1963 | Trachtenberg | 52/545 |
| 3,157,965 | 11/1964 | Watson | 52/394 |
| 3,363,380 | 1/1968 | Merrill | 52/530 |
| 3,458,962 | 8/1969 | Kendall | 52/531 |
| 3,485,004 | 12/1969 | Mattes | 52/531 |
| 3,520,099 | 7/1970 | Mattes | 52/531 |
| 3,552,078 | 1/1971 | Mattes | 52/520 |
| 4,054,012 | 10/1977 | Paradisi et al. | 52/551 |
| 4,079,562 | 3/1978 | Englert | 52/545 |
| 4,272,576 | 6/1981 | Britson | 52/545 |

*Primary Examiner*—James L. Ridgill, Jr.

*Attorney, Agent, or Firm*—Hirons, Rogers & Scott

[57] ABSTRACT

Several embodiments of wall covering are provided all of which are directed to providing an insulated wall covering including panels commonly called "siding". The wall covering is attached, by starting at the bottom of the wall and working upwards and is intended to provide a continuous insulating covering and to resist rattling and separation caused by building shrinkage. A starter strip or board is provided at the bottom of the covering to permit some movement to relieve compressive forces in the siding caused by building shrinkage. These forces are either transmitted directly from one piece of insulation to an adjacent piece of insulation, via structure forming part of associated siding panels, or by use of separate load transfer strips.

4 Claims, 10 Drawing Figures

PANEL LOCK STRUCTURE

This application is a Continuation-In-Part of application Ser. No. 06/085,352, filed on Oct. 16, 1979, now abandoned.

This invention relates to insulated wall coverings used on vertical surfaces of building structures and generally designed to simulate wood clapboard. Such coverings are commonly referred to as "siding".

It is common practice to cover vertical surfaces of both new and old building structures with horizontally extending panels which interlock vertically with one another. Materials used include steel or aluminum coated with an enamel exterior finish as well as extruded synthetic plastic. After assembly the resulting siding gives the appearance of wood clapboard, but because the material has a durable finish, it has the advantage that it is essentially maintenance free.

With recent increased interest in energy conservation, there has been more use of insulation material positioned under the siding. This insulation is commonly made up of shaped boards which are positioned under the siding. Such insulating boards are commonly called "backer boards". The resulting wall covering enhances the insulating qualities of the wall without affecting the pleasing appearance of the siding.

It is well recognised that after installation the wall covering must be capable of withstanding minor impacts and the panels must remain in position in heavy wind. Also the panels should resist rattling and wherever possible remain firmly positioned during movements caused by temperature fluctuations. However it is not always appreciated that some of the problems arising with installations of siding originate with building shrinkage. Shrinkage occurs vertically in many building structures and it is caused both by compressive forces and by wood shrinkage in a direction across the grain of the wood at floor and ceiling joists. Such shrinkage is particularly pronounced in new buildings where the transverse members such as floor and ceiling joists dry and shrink significantly with age. As a result the vertical extent of the outer surface of the building structure is effectively reduced and there is then a tendency for the siding panels initially to become looser and to rattle in the wind, and then in some cases to become disengaged from one another. Such disengagement occurs mainly at the first floor level or at the bottom of the siding where the installation was started. Subsequently it can be re-connected properly only by first disassembling the remaining siding and then re-applying it to the building structure.

The present invention is embodied in several aspects all of which are directed to providing an improved insulated wall covering and more particularly one which better resists rattling and separation caused by building shrinkage.

The invention will be better understood with reference to the drawings, in which.

Figure 1:
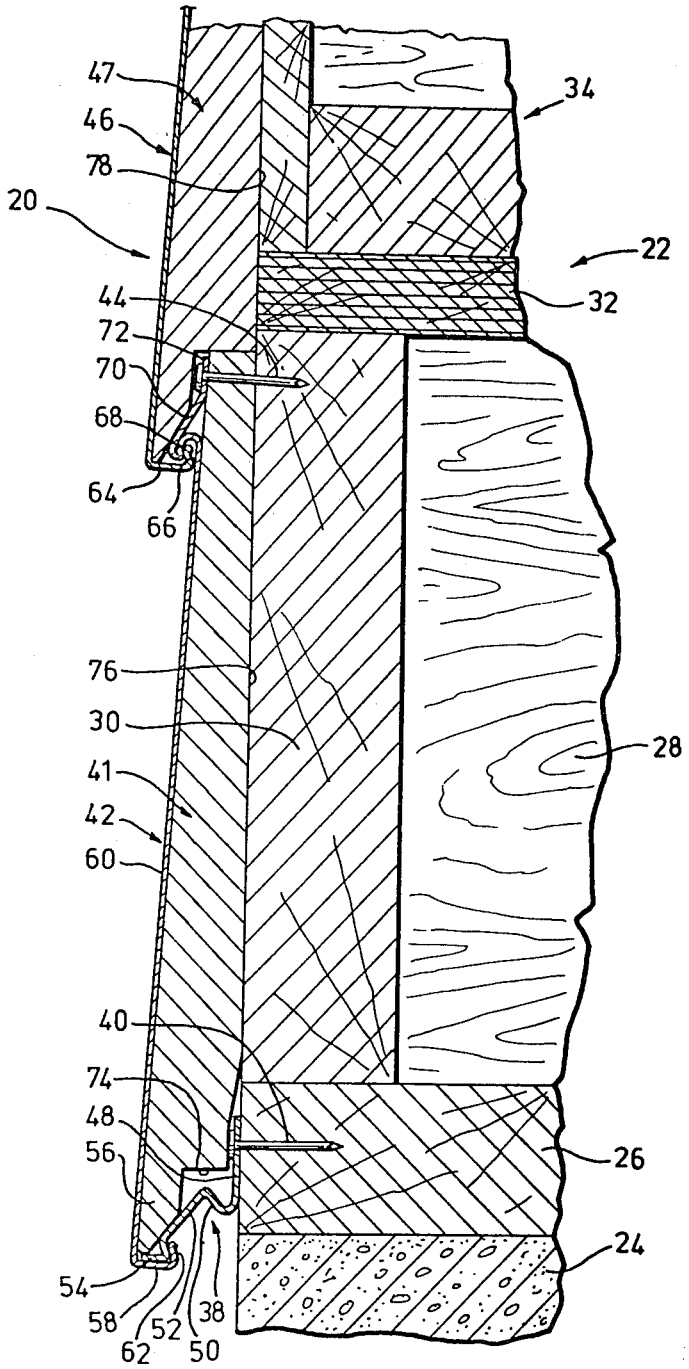
FIG. 1 is a sectional view of a lower part of a new building structure and showing a starter strip according to one embodiment of the invention as well as a first embodiment of wall covering used with the starter strip.

Reference is first made to FIG. 1 which shows a wall covering 20 assembled on a new building structure 22. The structure 22 is conventional in form and includes a foundation 24, plate 26, floor joists 28 covered by end piece 30, plywood floor 32, and wall structure 34. The outer surfaces of end piece 30 and plate 26 are sometimes covered first with a sheathing but in this illustration the siding is applied directly to these parts.

The siding 20 includes a bottom starter strip indicated generally by the numeral 38 and attached by a nail 40 passing through the strip and into the plate 26. The starter strip 38 is first attached to the building structure and then a tapered backer board 41 and an edge structure of a siding panel 42 are positioned on the strip and located using a nail 44 which is engaged in the end piece 30. A further siding panel 46 has an edge structure similar to that at the bottom of panel 42 and this is inter-engaged in a second edge structure at the upper extremity of panel 42. This conventional inter-engagement structure is shown in the art as a "Pittsburgh lock". Panel 46 is associated with a further backer board 47 and it will be appreciated that further panels and backer boards are provided sufficient to cover the surface of the building structure.

Returning to the starter strip 38, it will be seen that the strip consists of an upwardly-extending nailing flange 48 through which the nail 40 passes, an S-shaped portion 50 dependent from a lower extremity of the flange 48 and extending generally outwardly, and an outwardly and downwardly inclined ramp 52 dependent from the S-shaped portion 50. The S-shaped portion 50 and ramp 52 combine to form a leg which terminates at a step 54 extending outwardly from the bottom of the ramp 52 to support a lower extremity of the backer board 41. The S-shaped portion 50 of the starter strip is provided to permit deflection of the step 54 downwards with reference to the flange 48 and nail 40. More generally the leg can take any form which would permit downward movement of step 54 without disengagement from the panel 42.

It will be seen in FIG. 1 that the backer board 41 sits on the step 54 of the strip 38 and also that the nail 44 passes both through the panel 42 and through the backer board 41. Consequently the relative positions of these two parts are defined. Also, the backer board 41 includes a downward projection 56 resting on the step 54 and the step is retained inside a land 58 dependent from a bottom end of a main portion 60 of the panel 42.

The land 58 forms part of the edge structure and projects rearwardly terminating at an inwardly or upwardly dependent lip 62 positioned behind the step 54. It will be seen that the projection 56 combines with the land 58 and lip 62 to retain the step 54 in position. Any downward movement of the panel 42 will be absorbed by deformation of the S-shaped portion of the starter strip without disengagment of the panel from the starter strip.

The land 58 and lip 62 form part of a Pittsburgh lock which is shown fully at the top of panel 42. The further panel 46 includes a land 64 and lip 66 combining with a downwardly-opening channel 68 formed by a fold 70 in the panel 42. This panel terminates at a nailing flange 72 which projects upwardly from the fold 70 in line with the main portion 60 of the panel. It will be evident that the panel 46 is engaged in the panel 42 by moving the panel 46 upwardly so that the lip 66 engages in the channel 68. The panel 46 and backer board 47 can then be retained in position using a nail in a similar manner to nail 44 which holds panel 42. Also, the backer board 47 behind panel 46 is engaged in the same manner as the backer board 41 previously described.

Returning to the backer board 41, it will be seen that at its lowest extremity adjacent the projection 56 a lower surface or shoulder 74 is formed and that the rear face 76 of the backer board is coplanar with a similar rear face 78 of the backer board 47. This can be advantageous when covering a building having clapboard elements because the flat rear surface presented by the backer board tends to extend across the irregularities of the clapboard and simplify the assembly of the siding. Also on new buildings the shape effectively fills the space available providing better insulation because there is no significant space to permit convection of heat caused by air moving upwardly in space behind the siding.

After a structure such as that shown in FIG. 1 has been assembled, it will be evident that if the building structure parts previously described were to shrink, then there would be a distributing force extending vertically between the backer boards tending to maintain the vertical extent of the siding irrespective of the shrinkage of the building. For instance if the joists 28 and end piece 30 were to shrink, the floor 32 would drop towards the foundation 24 and parts of the siding above the floor would tend to be carried with them. The panels and associated backer boards move in unison because the force would be transmitted by the lower surface of backer board 47 to the upper surface of backer board 41. This board would then tend to cause deflection of the backer board 41 and panel 42 and this deflection would be absorbed by the starter strip 38 without separation. Similarly, because of this transmission of force the position of lip 66 in the channel 68 is retained thereby eliminating the possibility of separation caused by shrinkage.

In order to ensure this relationship, the exposed front surface of each panel after assembling will be substantially equal in vertical extent to the space between upper and lower surfaces of each backer board.

The foregoing discussion of shrinkage can be extended to the whole surface of a building structure. It will be evident that there will be a tendency for the wall covering to settle into a new position after shrinkage and that not all of the siding panels will move downwardly. This is because the wall covering can be considered to be a rigid structure held in position by a plurality of nails having some flexibility. It will be evident that any force results in a reaction and that if the forces toward the bottom of the wall covering resist further downward movement the rigidity of the covering will result in an upward displacement of the upper part of the covering relative to a portion of the building. In effect as the building shrinks some of the wall covering will tend to remain in position held there by lower parts of this covering with the result that it would appear that there has been slight upward movement at the top and downward movement at the bottom. It must be emphasized that these movements are quite small but that because the Pittsburgh lock relies on an inter-engagement of about $\frac{1}{4}''$ under ideal conditions it will be evident that without this force distribution by the backer board it would be possible for the siding panels to become loose and to rattle and that in extreme instances some of the panels will separate. Using the present wall covering the inter-engagement between siding panels is retained so that rattling is reduced and separation eliminated while at the same time expansion and contraction caused by temperature changes can take place unimpeded by the force transmission between backer boards.

It should also be appreciated that the projection on the backer board engages the land of the associated panel so that any downward force on the backer board is transmitted to the panel to pull the panel with the backer board. This also serves to ensure that the panel and backer board retain the same relationship. Of course, in the inexact art of installing siding there may well be some initial looseness between panels and between backer boards but this will not be allowed to increase and will be taken up when the building shrinks. For the purposes of this application the panels and backer boards are shown in the drawings in positions they will reach when the forces are transmitted. These are the critical positions which will be described and referred to in the claims.

Figure 2:
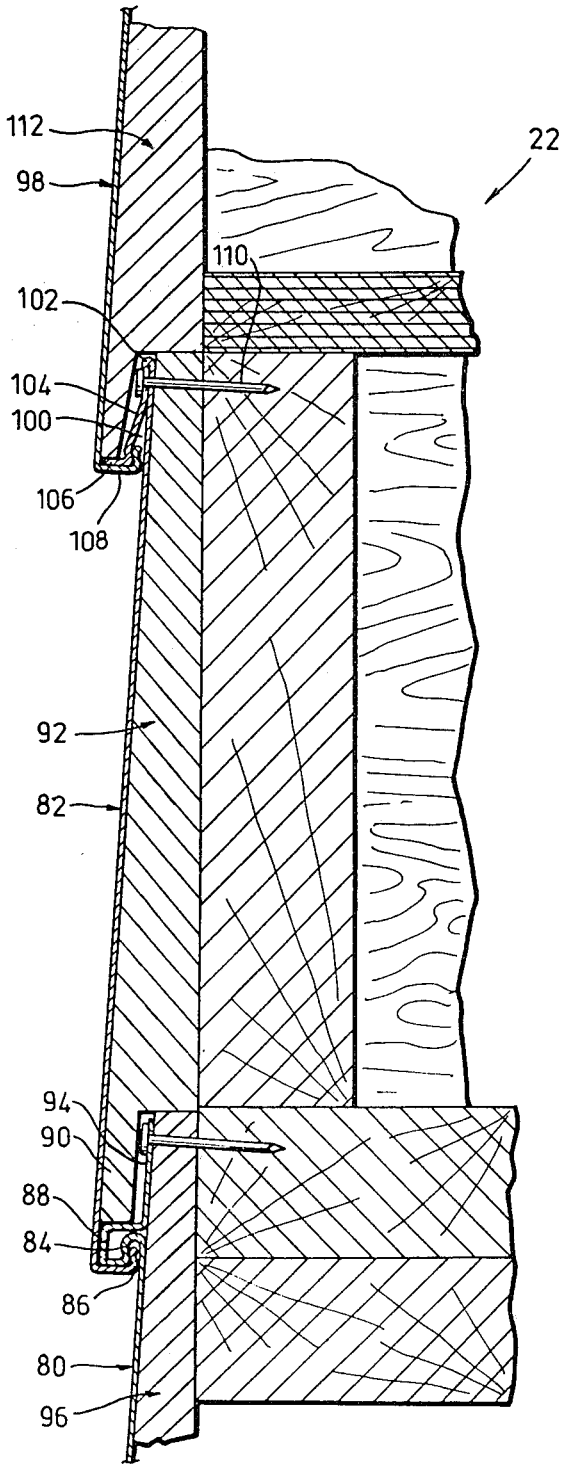
FIG. 2 is a sectional view similar to FIG. 1 and showing two other embodiments of a wall covering assembled at the second floor level of a two-storey structure.

Reference is next made to FIG. 2 which illustrates two alternative embodiments of wall covering shown built on an outer surface of a new building structure and also using tapered backer board. In the lower of these embodiments the upper edge or locking structure of a panel 80 is inter-engaged with complementary lower edge or locking structure of a lower part of a panel 82 at a lock which differs slightly from the conventional Pittsburgh lock. Although the lower edge structure of panel 82 is similar to that used in a Pittsburgh lock, the panel 80 includes a channel 84 receiving a lip 86 of panel 82. Also a step 88 is formed adjacent channel 84 to act as a support for a projection 90 of a backer board 92. This step is adjacent a nailing flange 94 of the panel 80 so that any downward force caused by the backer board 92 is transmitted by the projection 90 directly to the panel 80. This contrasts with the arrangement shown in FIG. 1 in that the backer board 92 is transmitting a force directly to the panel 80 instead of to the associated panel 82. As a result backer board 92 pushes both the panel 80 and the backer board 96 simultaneously.

An alternative embodiment is shown at the top of FIG. 2. Again a lower end of a panel 98 is of conventional Pittsburgh lock construction and it combines with a channel 100 formed by a reverse bend 102 having a leg 104 terminating in a step 106 which rests inside the land 108 of the Pittsburgh lock structure. A nail 110 passes both through the leg 104 and through a main portion of the panel 82 and a backer board 112 has a projection resting on the step 106. Also, board 112 is in engagement with an upper extremity of backer board 92 so that, as drawn, any downward force in the backer board 112 is transmitted directly to the panel 82 and to the backer board 92 simultaneously in a similar fashion to that of the embodiment shown at the bottom of FIG. 2.

The embodiments discussed so far require backer boards which have sufficient width at their lower extremities to engage on another backer board. In some instances parallel sided backer boards will be used and embodiments capable of using such backer boards are shown in FIGS. 3 and 4.

Figure 3:
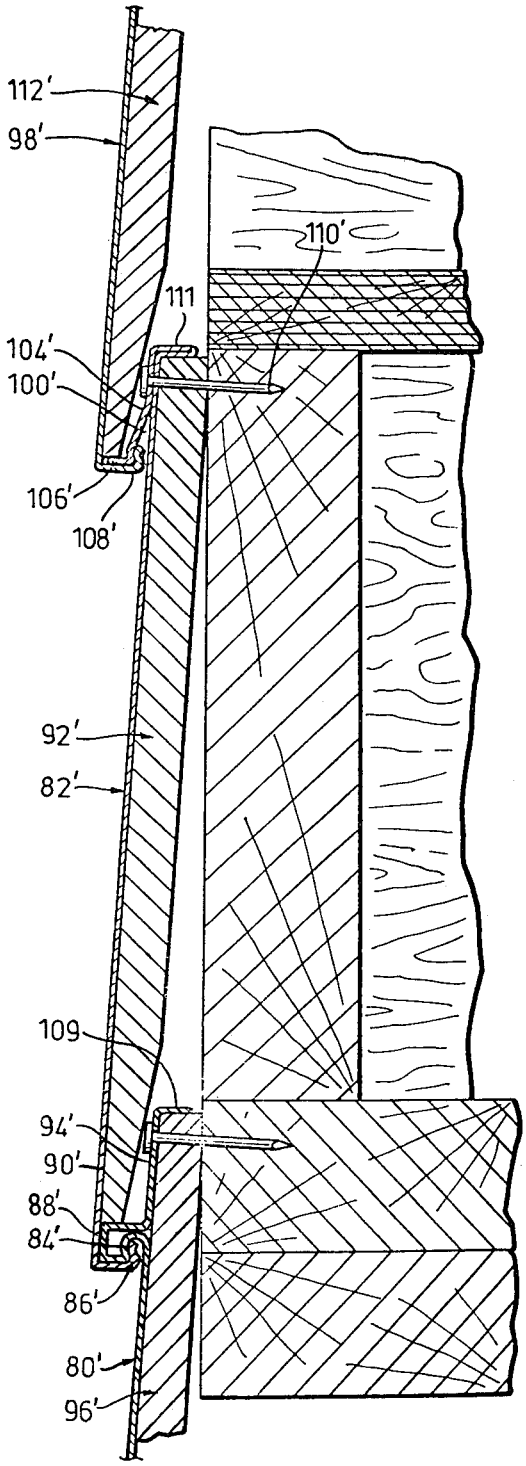
FIG. 3 is a view similar to FIG. 2 and showing alternative embodiments incorporating parallel-sided backer boards.

Reference is next made to FIG. 3. Parts corresponding to those described with reference to FIG. 2 will be given corresponding primed numerals. In this embodiment parallel-sided backer boards 96', 92' and 112' are contained behind respective panels 80', 82' and 98'. However panel 80' differs from panel 80 (FIG. 2) in that the upper edge structure of panel 80' also includes a rearwardly-extending cap 109. Consequently downward forces from backer board 92' are transmitted to panel 80' at step 88' and also by way of cap 109 to backer board 96'. This arrangement permits the use of standard parallel-sided backer boards.

The upper part of FIG. 3 shows an embodiment which differs from that of the lower part of FIG. 3 in that a cap 111 is formed differently as part of a different edge or locking structure. Otherwise the panels and backer boards co-operate in similar fashion to prevent separation.

Figure 4:
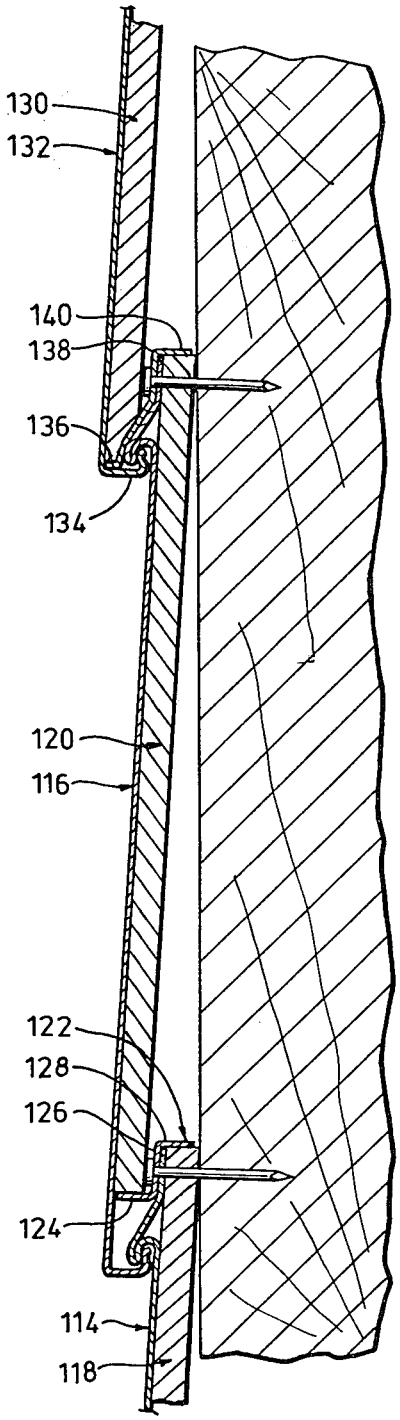
FIG. 4 is a more general view than that shown in FIG. 2 and illustrating two further embodiments of wall covering using support elements and parallel sided backer boards.

Reference is next made to FIG. 4 to describe a lower one of two embodiments which are for use in conjunction with a conventional Pittsburgh lock between panels 114, 116 having respective backer boards 118 and 120. The lower extremity of backer board 120 is located in contact with panel 116 and supported by a load transfer strip 122 which could either be continuous or take the form of a series of clips. The strip 122 defines a step or support ledge 124, a nailing portion 126 extending upwardly from the ledge 124 and terminating in a cap 128 resting on an upper extremity of the backer board 118 and panel 114. Consequently forces are transmitted from backer board 120 to strip 122 and hence to panel 114 and backer board 118.

The upper embodiment shown in FIG. 4 is particularly for use where the strip has a cap bearing only on the backer board and not on the panel. As shown, a backer board 130 is associated with a panel 132 which is engaged with panel 116 in a conventional Pittsburgh lock configuration. The lower end of a backer board 130 rests on a step 136 adjacent land 134. The step 136 is part of a load transfer clip or strip 138 which includes a cap 140 sitting on the upper extremity of the board 120. It will be evident that downward force from the backer board 130 will be transmitted to the step 136 which in turn will transmit the force firstly to the bottom of panel 132 so that this panel will move with backer board 130 and also by way of cap 140 to the board 120. Again such an arrangement will prevent separation of the panels upon shrinkage of the building structure.

Figure 5:
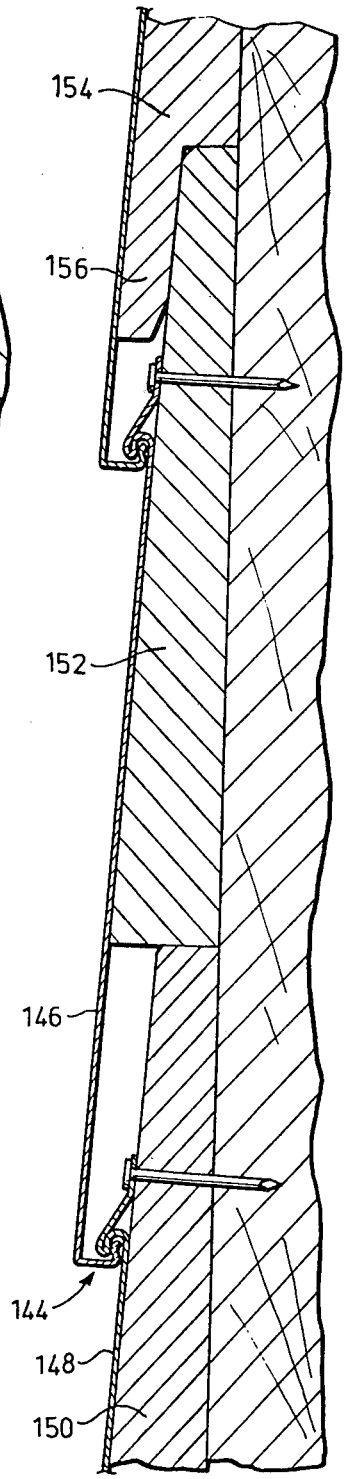
FIG. 5 is a view similar to FIG. 4 and showing yet two more alternative embodiments of wall covering according to the invention.

Reference is next made to FIG. 5 which illustrates an adhered backer board arrangement using conventional Pittsburgh locks. At the lower part of FIG. 5 an embodiment is shown in which a Pittsburgh lock 144 is provided between a panel 146 and a further panel 148. Panel 148 has a tapered backer board 150 attached to it and projecting upwardly beyond the Pittsburgh lock 144. Similarly, a backer board 152 is associated with panel 146 and the boards 150, 152 abut with one another as shown. Although this arrangement of backer boards facilitates assembly, the backer board can be terminated immediately above the Pittsburgh lock. Such arrangements will take advantage of the inventive characteristics of previously described panels in which the backer boards are of the drop-in type. Once the panel 148 has been assembled, panel 146 and attached backer board 152 are positioned by initially engaging the backer board 152 against backer board 150 and sliding the panel 146 upwardly to engage the Pittsburgh lock 144. At this point the backer board 152 can be moved towards the building structure and into the position shown. Any downward force from the panel 146 will then be transmitted directly by backer board 152 to the backer board 150 and hence to the panel 148. Consequently the Pittsburgh lock will remain in firm engagement.

In the upper part of FIG. 5 a simplified Pittsburgh lock arrangement is also shown without the nailing flange normally used with this type of lock. Nailing is provided directly through the insulation which is provided by a backer board 154 which has a projection 156 extending below the upper extremity of backer board 152. The principle of operation is the same as the embodiment shown at the bottom of FIG. 5 but the resulting insulation and rigidity may make this embodiment more desirable than that shown at the bottom of FIG. 5.

Figure 6:
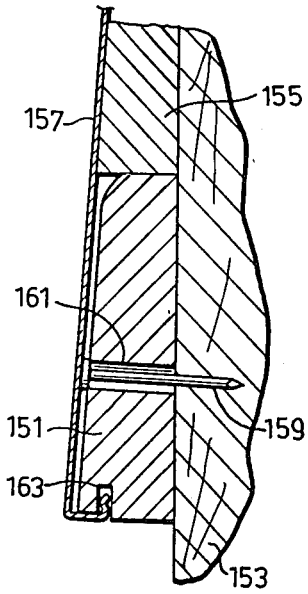

A suitable starter arrangement is shown in FIG. 6 for the lower embodiment illustrated in FIG. 5. In this starter arrangement a small backer board or starter board 151 is attached to a building structure 153 to fill the space below full backer board 155 attached to panel 157. The starter board 151 is shaped to give some clearance for the head of a nail 159 which is engaged in a vertically orientated slot 161 of the board 151. Also, the board 151 defines a downwardly-opening recess 163 containing a lip of the Pittsburgh lock of panel 157.

In use the board 151 is first attached to structure 153 using nails 159 positioned in slots 161 to permit vertical downward movement of board 151. Structural shrinkage will cause board 155 and panel 157 to move in unison so that board 155 will push board 151 downwardly thereby maintaining engagement between panel 157 and board 151.

If preferred the exposed lower extremity of board 151 can be covered, treated with weatherproof material, or made entirely from such material.

Figure 7:
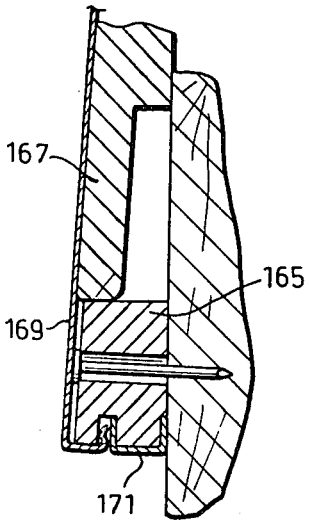
FIGS. 6 and 7 are views similar to FIG. 5 and showing starter boards for use with the FIG. 5 wall coverings.

FIG. 7 also shows a starter board which in this case is to be used with the upper embodiment shown in FIG. 5. A board 165 is shaped to fit under a full board 167 and co-operates with a panel 169 in similar fashion to panel 157 and board 151 (FIG. 6). However the board 165 is also shaped to receive a weatherproofing cover 171 of synthetic plastic material or of metal. It will be appreciated that the board 165 can be formed of relatively rigid weatherproof materials such as extruded vinyl, fibrous materials, wood, metal, or foamed plastic materials.

Figure 8:
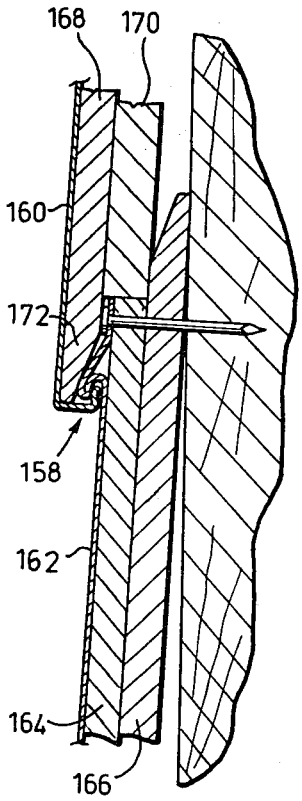
FIG. 8 is another view similar to FIG. 4 and showing one more embodiment of the invention having an alternative to the backer board shown in FIG. 1.

When using a drop-in backer board, the embodiments such as those shown in FIGS. 1 and 2 require a backer board which has a preferred orientation. Where it is desired to use parallel-sided backer board for economy, backer board such as that shown in FIG. 8 can be used. As seen in FIG. 8 a Pittsburgh lock arrangement 158 is used between panels 160 and 162 and that the drop-in backer board behind panel 162 is made up of a first part 164 which is attached by gluing (or an equivalent process) to a similar second part 166. Parts 164 and 166 are inverted relative to one another so that as can be seen from similar parts 168, 170 of the board associated with panel 160, a downward projection 172 formed by part 168 is duplicated by the rearward part as indicated at the top of part 166. Consequently these boards are symmetric and can be placed behind a panel irrespective of their orientation. However it will be appreciated that an air space will exist between the panels and the building structure and that where it is desired to use a drop-in backer board without air space on a new building it will be preferable to use one of the structures shown in FIGS. 1 and 2.

It will also be evident that a backer board could be formed conventionally having the same shape as that presented by the comination of boards 168,170.

Figure 9:
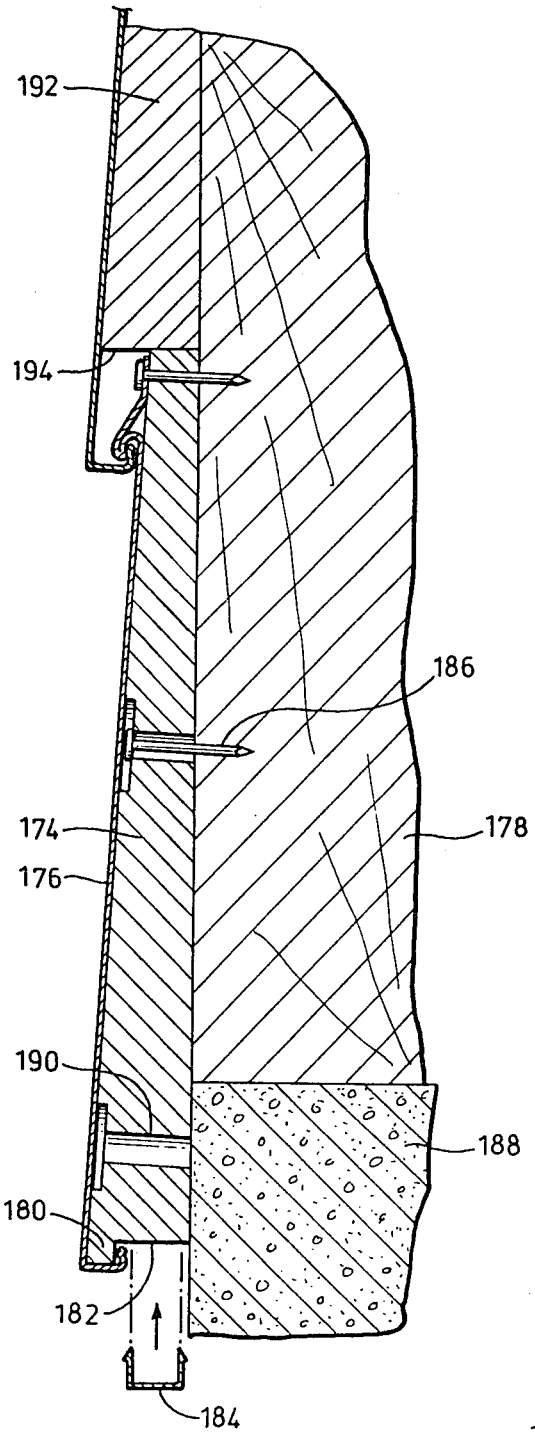
FIG. 9 shows a starter board for use with wall coverings such as that shown in FIG. 1.

All of the above structures are capable of distributing compressive loads without causing panel separation provided of course that a suitable starter strip such as that shown in FIG. 1 is used. However an alternative to this strip would be any starter structure capabale of allowing some movement to relieve compressive stresses built up in the wall covering as the building shrinks. One alternative to the starter strip is shown in FIG. 9 and the full starter board 174 is located behind a panel 176 and attached to a vertical surface of a building structure 178. The panel 176 is interlocked with another panel 180 having a backer board 182 and at a Pittsburgh lock 184. Assembly is similar to that described with reference to FIG. 6 with nails 186 being positioned in slots with the heads given clearance behind panel 176. The bottom of board 174 could be similar to the bottom of corresponding boards shown in FIGS. 6 and 7 but is shown to provide a projection 180 engaged in the internal channel at the bottom of panel 176. A shoulder 182 adjacent the projection provides clearance for receiving a U-shaped weatherproof cover strip 184 which is engaged after assembly of the panel 176 if desired.

The building structure 178 shown in FIG. 9 has brickwork 188 at the bottom and the board 174 overlaps this part.

The board 174 is below a board 192 which preferably has a flat bottom surface 194 for resting both on the panel 176 and on the board 174. Compressive forces are therefore transmitted both to the board 174 and to the panel 176. Such an arrangement could also be used in other embodiments.

Figure 10:
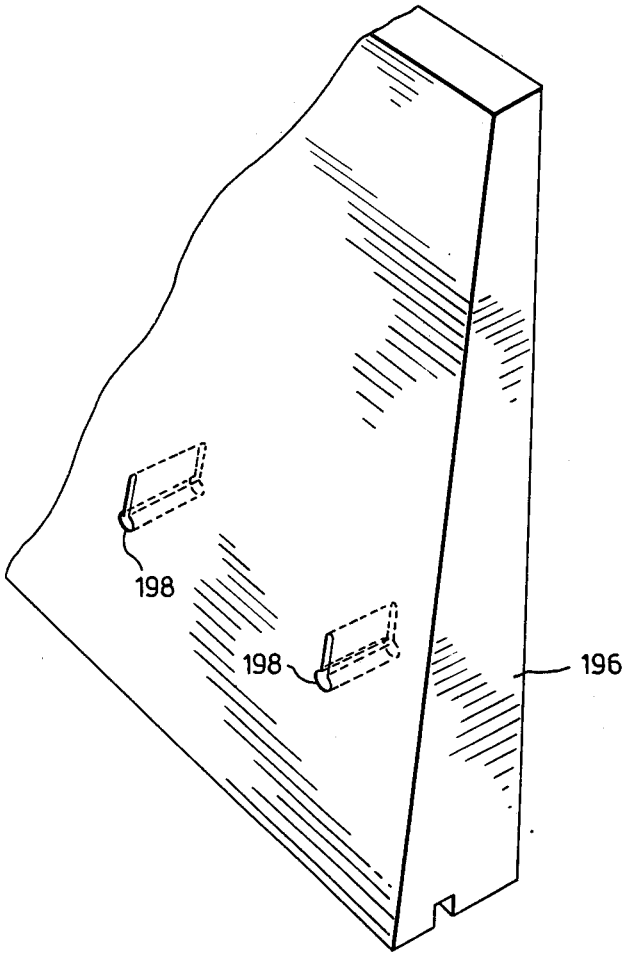
FIG. 10 is a perspective view of a portion of another starter board.

FIG. 10 illustrates a starter board 196 having openings 198 pre-formed to receive nails. These openings are in the form of inverted key-holes with the slotted upper portions in the form of slits. The installer will place the nails through the round bottom parts of the openings. When the building shrinks, the board will slide over the nails with the nails entering the slots. This arrangement minimises the load on these nails while nevertheless locating the starter board positively.

It will be evident from the foregoing description of various embodiments of wall coverings and starter structure that the invention can take many forms within the scope of the invention as defined in the claims.

What I claim as my invention:

1. A building structure having an outer wall covering comprising:

a plurality of elongated insulated backer boards having upper and lower surfaces arranged substantially in contact with one another, the backer boards being attached to the building structure and arranged to transfer compressive vertical loads from each of the backer boards to adjacent backer boards;

a plurality of interlocked and elongated siding panels arranged in lapped relationship, each of these panels having rearwardly extending upper and lower lands and a main portion covering at least a substantial portion of the vertical extent of one of the backer boards, the panels being attached to the outer wall;

a starter structure attached to the outer wall and positioned at the bottom of the wall covering, the starter structure including an outwardly extending portion positioned immediately under a lowermost one of the backer boards and in engagement with the underside of this backer board and immediately above the lower land of the bottom one of the siding panels so that compressive loading in this backer board is relieved by the starter structure, the compressive loading also serving to lock the starter structure portion between the lowermost backer board and the lower land of the bottom panel to prevent separation of the panel from the starter structure as a result of the compressive loading in the backer board.

2. Building structure having an outer wall covering comprising:

a plurality of interlocked and elongated siding panels, at least the lowermost panel having a rearwardly extending land and a lip attached to the land which extends upwardly from the rear of the land;

a starter strip having a flange positioned on the building surface and attached to the building surface, a step extending generally horizontally and spaced outwardly from the flange above said land and outwardly of said lip, and a resilient leg extending downwardly and outwardly between the flange and the inner extremity of the step;

backer boards positioned behind the panels, the lowermost one of which has its lowermost extremity resting on the step thereby trapping the step between the backer board and the land, the lowermost panel being retained by engagement of the lip behind the step and by compressive loading in the backer board which is relieved by deflection of the leg and which enhances the engagement of the panel with the starter strip because said step is then trapped between the backer board and said land; and means cooperating with upper locking structures of the panels to retain the wall covering against said outer wall.

3. A building structure having an outer wall covering comprising:

a plurality of elongated insulating backer boards having parallel longitudinal upper and lower surfaces and arranged substantially parallel with one another in spaced relationship on said outer wall;

a plurality of elongated siding panels arranged in lapped relationship and covering the backer boards, each of the panels having upper and lower locking structures engaged in corresponding locking structures of adjacent panels and each of the upper locking structures have a cap firmly engaged on the upper surface of an associated one of the backer boards, and a ledge rigidly coupled to the cap and supporting the lower surface of an upwardly adjacent backer board whereby compressive forces are transmitted from one backer board to an adjacent backer board by way of the associated ones of the caps and ledges, and the lower locking structure of the lowermost panel having a rearwardly extending land and a lip attached to the land which extends upwardly from the rear of the land;

a starter strip having a flange positioned on the building surface and attached to the building surface, a step extending generally horizontally and spaced outwardly from the flange above said land and outwardly of said lip, and a resilient leg extending downwardly and outwardly between the flange and the step so that the backer board behind this panel rests on the step with the step trapped between the backer board and the land, the panel being retained by engagement of the lip behind the step and by the compressive loading in the backer board which is relieved by deflection of the leg and which enhances the engagement of the panel with the starter strip because said step is then trapped between the backer board and said land; and means cooperating with the upper locking structures of the panels to retain the wall covering against said outer wall.

4. A building structure having an outer wall covering comprising:

a plurality of elongated insulating backer boards having parallel longitudinal upper and lower surfaces and arranged substantially parallel with one another in spaced relationship on said outer wall;

a plurality of elongated siding panels arranged in lapped relationship and covering the backer boards, each of the panels having upper and lower locking structures engaged in corresponding locking structures of adjacent panels;

a plurality of load transfer strips each of which has a cap firmly engaged on the upper surface of one of the backer boards and a ledge supporting an upwardly adjacent one of the backer boards whereby compressive forces are transmitted from one backer board to an adjacent backer board by way of the associated one of the strips, and the lower locking structure of the lowermost panel having a rearwardly extending land and a lip attached to the land which extends upwardly from the rear of the land; and a starter strip having a flange positioned on the building surface and attached to the building surface, a step extending generally horizontally and spaced outwardly from the flange above said land and outwardly of the lip, and a resilient leg extending downwardly and outwardly between the flange and the inner extremity of the step so that compressive loading in the backer board is are relieved by deflection of the leg, this compressive loading enhancing the engagement of the panel with the starter strip because said strip is then trapped between the backer board and said land.

* * * * *